US009578911B2

(12) United States Patent
Fildan et al.

(10) Patent No.: US 9,578,911 B2
(45) Date of Patent: Feb. 28, 2017

(54) REVERSIBLE LOCKING GARMENT CLOSURE

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: DUBROSKY & TRACY PATENT SERVICE CORP., Central (HK)

( * ) Notice: Subject to any disclaimer, the term of this patent is extended or adjusted under 35 U.S.C. 154(b) by 313 days.

(21) Appl. No.: 14/524,184

(22) Filed: Oct. 27, 2014

(65) Prior Publication Data

US 2016/0113341 A1 Apr. 28, 2016

(51) Int. Cl.
*A41F 1/00* (2006.01)
*A44B 11/25* (2006.01)

(52) U.S. Cl.
CPC ..... *A41F 1/006* (2013.01); *A44B 11/2596* (2013.01); *A41F 1/00* (2013.01)

(58) Field of Classification Search
CPC ..... A44B 11/2596; Y10T 24/3403; Y10T 24/3405; Y10T 24/45194
USPC ..... 450/79, 80, 91, 58
See application file for complete search history.

(56) References Cited

U.S. PATENT DOCUMENTS 2,956,324 A * 10/1960 Klein ..... A44B 11/2596 24/323
3,979,801 A * 9/1976 Tareau ..... A41F 1/006 24/587.12
2014/0364037 A1* 12/2014 Bailey ..... A41C 3/02 450/58

FOREIGN PATENT DOCUMENTS

EM 002479709-0001 S 6/2014
EM 002479709-0002 S 6/2014
EM 002479709-0003 S 6/2014

OTHER PUBLICATIONS

U.S. Appl. No. 29/500,632, filed Aug. 27, 2014, Fildan, G.

* cited by examiner

*Primary Examiner* — Gloria Hale
(74) *Attorney, Agent, or Firm* — Kintner IP, LLC; Mary Frances Ludwig

(57) ABSTRACT

A reversible locking garment closure includes male and female members each attached to an end of a garment. The male member has a pin at an acute angle and the female member receives the pin in a corresponding angled channel. The acute angle provides resistance to decoupling the male and female members, and allows the closure to function under high tensile stress. The male and female members are coupled via motion in a plane parallel to the front and rear faces of the closure, allowing the closure to be operable when worn in a reverse orientation. In an embodiment, the closure includes a locking mechanism which resiliently resists decoupling of the male and female members.

18 Claims, 5 Drawing Sheets

REVERSIBLE LOCKING GARMENT CLOSURE

CROSS REFERENCE TO RELATED APPLICATION

None

TECHNICAL FIELD

The present invention pertains generally to closures, and more particularly to a reversible locking garment closure.

BACKGROUND OF THE INVENTION

An object of this invention is to provide a garment closure which can resist high amounts of stress, such as desirable for sportswear, yet still be easily operable, versatile, and aesthetic. A reversible closure is desired to provide increased utility and style. Prior art closures with locking features are typically not reversible. For example, U.S. Pat. No. 6,009,604 (Fildan) discloses a closure involving inserting one or more bars of the male member into corresponding channels of the female member and rotating the members until they are coplanar, thereby locking the closure. The rotation required for this type of closure does not accommodate a reversible garment, as operation in the reverse orientation requires excessive stretching of the garment and would be inconvenient or uncomfortable against the body of the wearer.

BRIEF SUMMARY OF THE INVENTION

The present invention is directed to a garment closure which is reversible and includes several locking features. The closure has male and female members, each being attached to one end of the garment. The male member includes a pin positioned at an acute angle to the exterior side of the male member, and the female member includes a corresponding first channel which receives the pin. The acute angle provides resistance to decoupling the male and female members, and allows the closure to function under high tensile stress.

In accordance with an embodiment of the closure, a locking mechanism is included on at least one of the male and female members for resiliently resisting decoupling thereof.

In accordance with another embodiment, the closure has two faces parallel to the plane of the coupling motion of the male and female members. When the closure is closed, the two faces are substantially mirror images, and the closure is therefore reversible.

In accordance with another embodiment, the first channel is open to the top of the female member and closed to the bottom of the female member.

In accordance with another embodiment, the male member has a body to which the pin is connected by a web. The female member has a second channel which receives the body and a slit which loosely receives the web. In an embodiment, the second channel is open to both the top and bottom ends of the female member. In another embodiment, the second channel is open along the entire length of the interior side of the female member.

In accordance with another embodiment, the pin has a substantially flat pin face. This feature provides resistance to decoupling the male and female members under tensile stress.

In accordance with another embodiment, the male and female members each include a loop whereon an end of the garment is connected.

In accordance with another embodiment, the acute angle of the pin is between about three and about fifteen degrees.

In accordance with another embodiment, the bottom of the pin is rounded to facilitate insertion into the first channel. Other embodiments, in addition to the embodiments enumerated above, will become apparent from the following detailed description, taken in conjunction with the accompanying drawings, which illustrate, by way of example, the principles of the closure and garment therewith.

LIST OF DRAWING REFERENCE NUMERALS

Figures 1, 2:
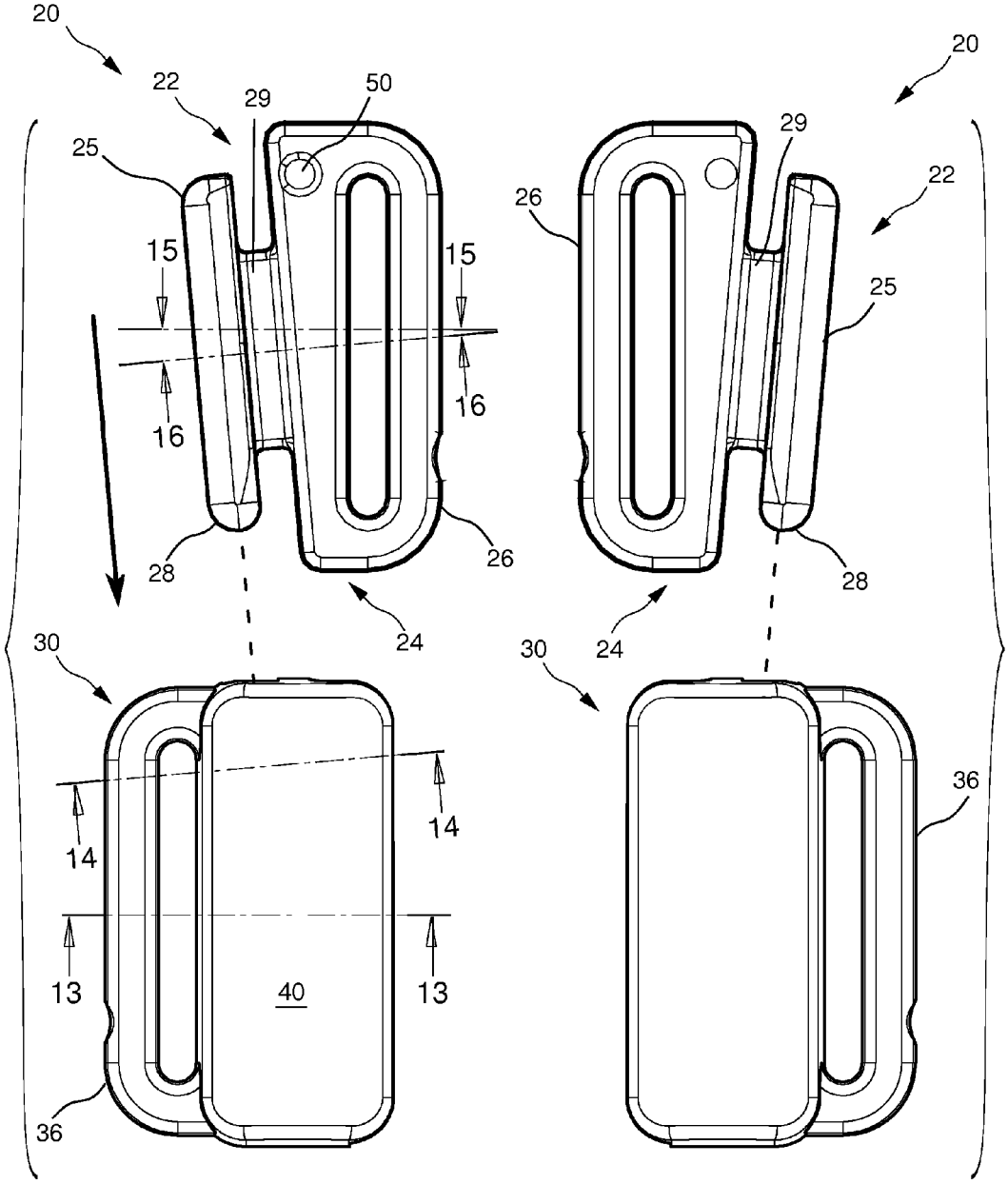
FIG. 1 is an exploded front elevation view of a reversible locking garment closure.
FIG. 2 is an exploded rear elevation view of the closure.

20 closure
22 male member
24 body
25 pin
26 male exterior side
27 pin face
28 pin bottom
29 web
30 female member
32 top end
33 bottom end
34 first channel
35 second channel
36 female exterior side
37 interior side
38 slit
40 first face
42 second face
50 protrusion
52 indentation
500 garment
510 first end
520 second end

DETAILED DESCRIPTION OF THE INVENTION

Referring initially to FIGS. 1 and 2, there are illustrated, respectively, exploded front and rear elevation views of a reversible locking garment closure. The closure, generally designated as 20, includes a male member 22 and a female member 30. The male and female members are preferably each a unitary molded piece. When fastening the closure, male member 22 is coupled to female member 30 along the direction of the arrow of FIG. 1. Closure 20 is particularly suited for use with garments such as sport brassieres, swimwear, and lingerie, however its utility is not limited to these applications.

Figure 3:
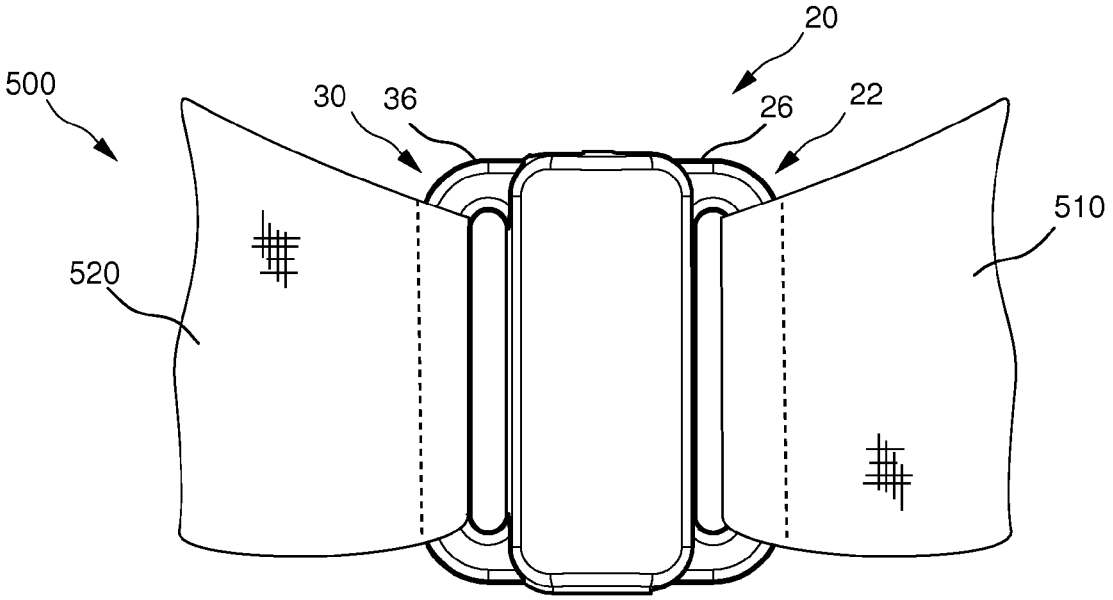
FIG. 3 is a reduced front elevation view of the closure connected to a garment.
Figure 4:
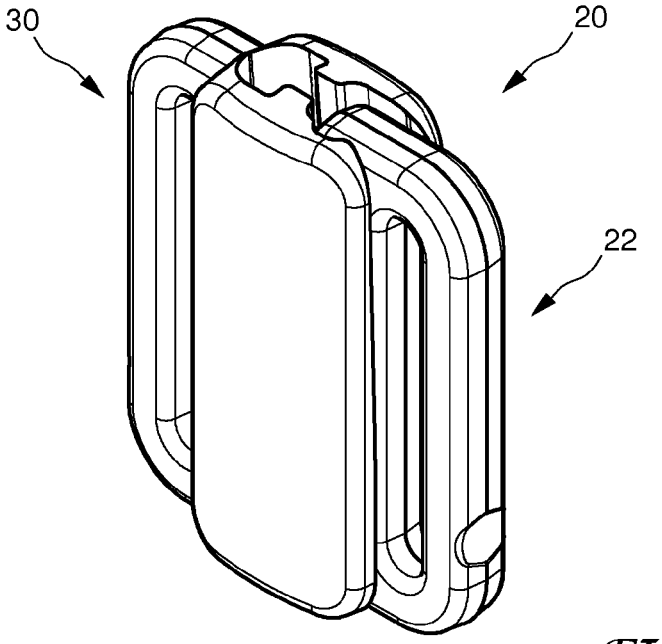
FIG. 4 is a perspective view of the closure.

FIG. 3 is a reduced front elevation view of closure 20 in a closed position and connected to a garment 500. Garment 500 has a first end 510 and a second end 520 which are connectable by means of closure 20. Male member 22 and female member 30 have, respectively, male and female exterior sides 26 and 36. First end 510 of garment 500 is connected to male exterior side 26 and second end 520 is connected to female exterior side 36. In the shown embodiment, ends 510 and 520 are connected, respectively, to exterior sides 26 and 36 of closure 20 by feeding the fabric of the garment end through a loop in the exterior side and stitching the fabric of the garment end to itself (as indicated by the dashed lines of FIG. 3). Ends of the garment may be connected to exterior sides of the closure by other methods well known in the art including simply passing the end through the opening for attachment elsewhere on the garment, as in the case of a strap.

Referring again to FIGS. 1-2, male member 22 has a pin 25 which is positioned at an acute angle to male exterior side 26. Female member 30 has a first channel 34 for receiving pin 25 (see FIG. 12). In operation, pin 25 is inserted into first channel 34, thereby coupling male member 22 and female member 30. In this manner, first and second ends 510 and 520 of garment 500 are connectable. First channel 34 is positioned at an acute angle, θ, to female exterior side 36, that acute angle corresponding to the acute angle of pin 25. Therefore, when coupled, male exterior side 26 is substantially parallel to female exterior side 36.

The corresponding acute angles of pin 25 and first channel 34 provide resistance to decoupling male member 22 from female member 30 in the presence of transverse stress. In other words, the angle prevents sudden or accidental removal of the male from the female. The acute angle therefore provides a "self-locking" function. In a preferred embodiment, the acute angle of pin 25 and male exterior side 26 is between about three degrees and about fifteen degrees.

FIGS. 4-10 are, respectively, perspective, front elevation, left and right side elevation, top and bottom plan, and rear elevation views of closure 20. Closure 20 has a first face 40 and a second face 42. When male member 22 and female member 30 are coupled, first face 40 and second face 42 are substantially mirror images. The coupling and decoupling motion of male member 22 and female member 30 occurs in a plane substantially parallel to first face 40 and second face 42 (refer to FIG. 1). In other words, closure 20 may be worn with either first or second face 40 or 42 against the body of the wearer without interfering with the fastening operation. Closure 20 is therefore a reversible closure.

Figure 11:
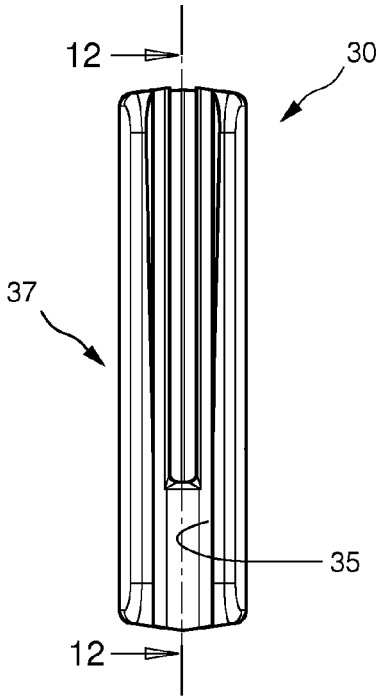
FIG. 11 is right side elevation view of a female member of the closure.
Figure 12:
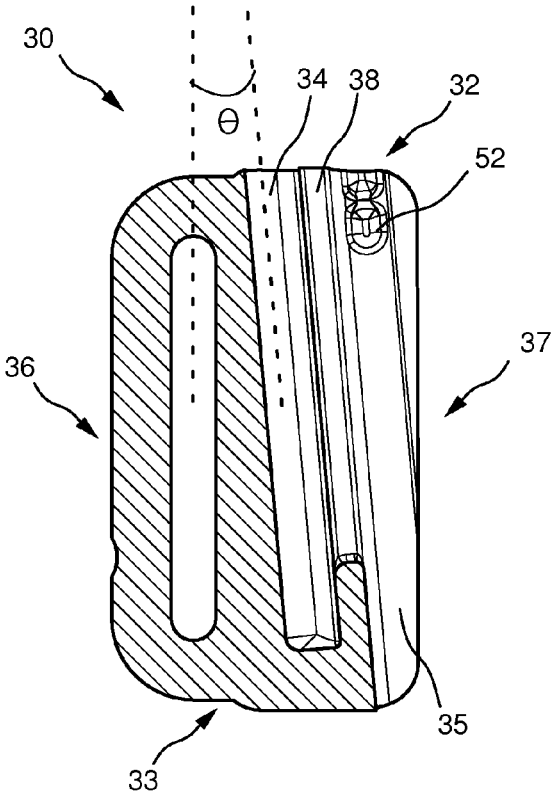
FIG. 12 is a cross-sectional view along the line 12-12 of FIG. 11.

FIG. 11 is right side elevation view of female member 30, and FIG. 12 is a cross-sectional view along the line 12-12 of FIG. 11. Female member 30 has a top end 32 and a bottom end 33. In the shown embodiment, first channel 34 is open to top end 32 and closed to bottom end 33 (see also FIGS. 8 & 9).

Male member 22 has a body 24 and a web 29 connecting pin 25 to body 24 (see FIGS. 1-2). Female member 30 has a second channel 35 for receiving body 24 of male member 22. First channel 34 and second channel 35 are connected by a slit 38 which loosely receives web 29. In the shown embodiment, second channel 35 is open to top end 32, bottom end 33, and along the entire length of the interior side 37 (see also FIG. 11).

Figure 8:
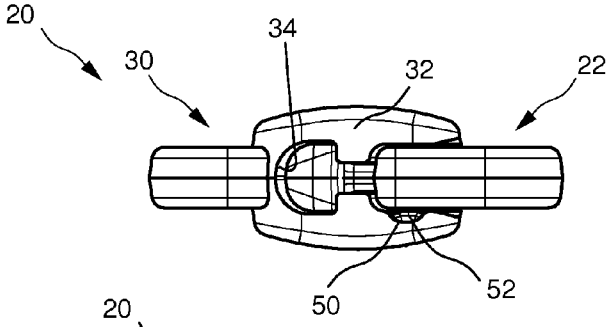
FIG. 8 is a top plan view of the closure.
Figure 6:
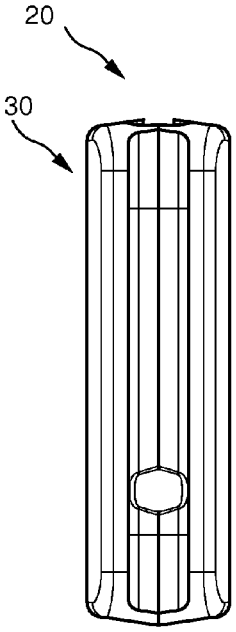
FIG. 6 is a left side elevation view of the closure.
Figure 5:
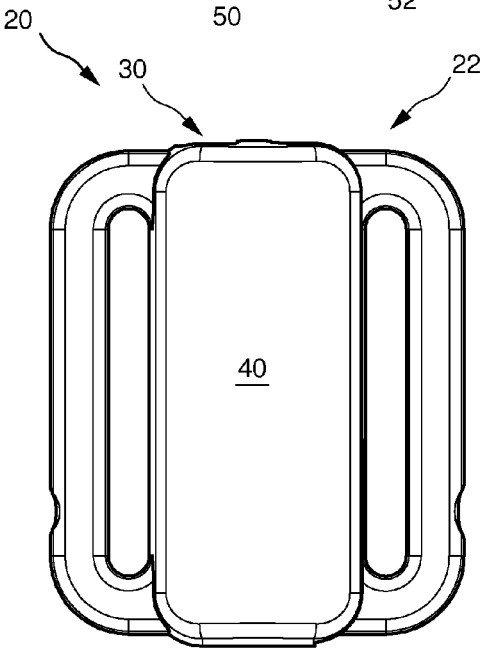
FIG. 5 is a front elevation view of the closure.
Figure 7:
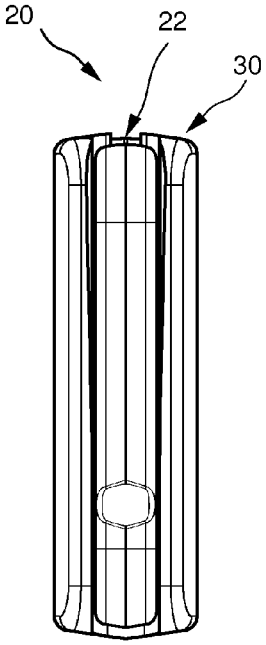
FIG. 7 is a right side elevation view of the closure.
Figure 9:
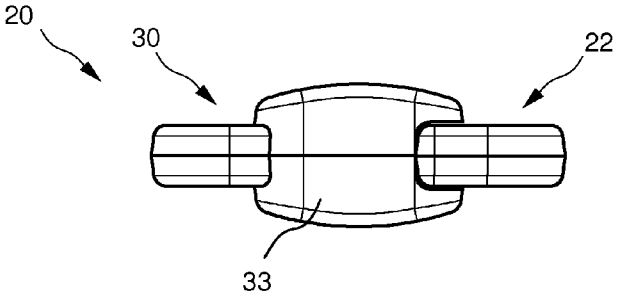
FIG. 9 is a bottom plan view of the closure.
Figure 10:
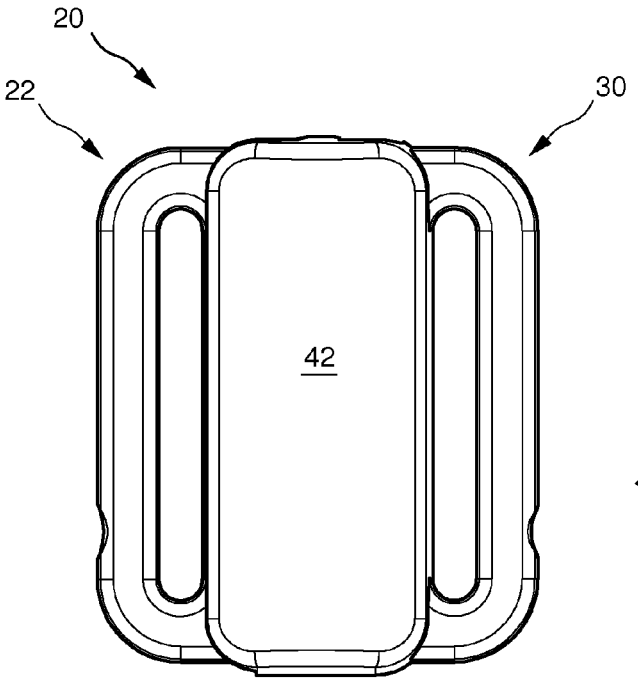
FIG. 10 is a rear elevation view of the closure.
Figure 16:
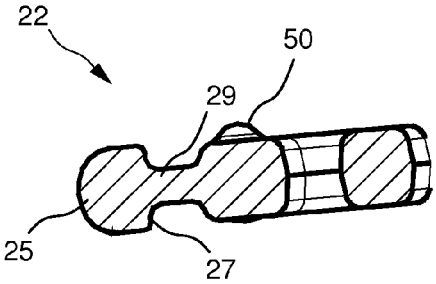
FIG. 16 is an enlarged cross-sectional view along the line 16-16 of FIG. 1.

In an embodiment, closure 20 includes a locking mechanism on at least one of male member 22 and female member 30 to resist decoupling of the male and female members. As shown in FIGS. 1, 8, and 16, male member 22 has a protrusion 50. Female member 30 has an indentation 52 in second channel 35 and near top end 32 (see FIG. 12). When coupling, protrusion 50 is resiliently accepted by indentation 52, into which protrusion 50 locks. Resiliently accepted means that some material deformation is required by female member 30 or male member 22 so that indentation 52 may accept protrusion 50, and that female member 30 and male member 22 regain their original shapes when the locking is complete. The force required to deform female member 30 or male member 22 must therefore be provided to remove protrusion 50 from indentation 52, thereby unlocking the mechanism. This locking mechanism makes an audible "click" when closed, indicated proper functioning of the closure to the wearer.

Figure 13:
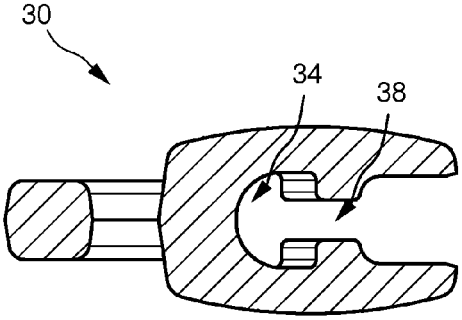
FIG. 13 is an enlarged cross-sectional view along the line 13-13 of FIG. 1.
Figure 14:
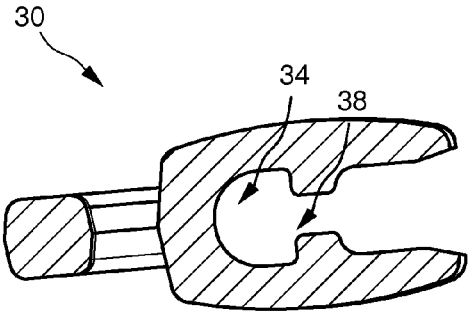
FIG. 14 is an enlarged cross-sectional view along the line 14-14 of FIG. 1.
Figure 15:
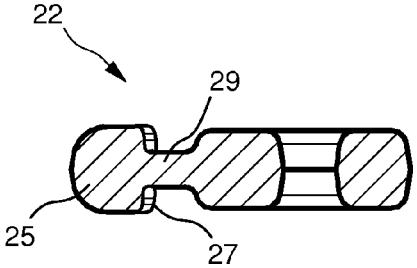
FIG. 15 is an enlarged cross-sectional view along the line 15-15 of FIG. 1.

FIGS. 13 and 14 are enlarged cross-sectional views of female member 30 along the lines 13-13 and 14-14, respectively of FIG. 1. FIGS. 15 and 16 are enlarged cross-sectional views of male member 22 along the lines 15-15 and 16-16, respectively of FIG. 1. Pin 25 has a pin face 27 adjacent to web 29. Pin face 27 is substantially flat (not rounded) and first channel 34 has a corresponding flat surface. The flat pin face and corresponding flat channel surface contact when the closure is under tensile stress, and act to resist decoupling of male member 22 from female member 30. (Decoupling under tensile stress would occur by pulling pin 25 out of first channel 34 through slit 38).

In the embodiment of FIGS. 1-2, pin 25 has a pin bottom 28 which is rounded on all sides to facilitate the insertion of pin 25 into first channel 34.

The various locking functions of closure 20 combine to provide a resistance to decoupling under tensile stress of up to 40 pounds.

Further provided is a reversible brassiere including a reversible locking garment closure 20. The term brassiere is used herein to encompass various support garments such as sport brassieres, swimwear tops, and lingerie.

The embodiments of the closure described herein are exemplary and numerous modifications, combinations, variations, and rearrangements can be readily envisioned to achieve an equivalent result, all of which are intended to be embraced within the scope of the appended claims. Further, nothing in the above-provided discussions of the closure should be construed as limiting the invention to a particular embodiment or combination of embodiments. The scope of the invention is defined by the appended claims.

We claim:

1. A closure for a garment having a first end and a second end, the closure comprising:

a male member having a body, a male exterior side connected to the first end of the garment, a pin positioned at an acute angle to said male exterior side, and a web connecting said pin to said body;

a female member having a top end, a bottom end, an interior side, a female exterior side connected to the second end of the garment, a first channel for receiving said pin, a second channel for receiving said body, and a slit connecting said first channel and said second channel, said slit loosely receiving said web; and, when said pin is inserted into said first channel, thereby coupling said male member and said female member and connecting the first and second ends of the garment, said male exterior side and said female exterior side being substantially parallel and said acute angle of said pin providing resistance to decoupling said male member from said female member.

2. The closure according to claim 1, further including:

a locking mechanism on at least one of said male and female members for resiliently resisting decoupling of said male and female members.

3. The closure according to claim 1 having a first face and a second face, the closure further including:

when said male member and said female member are coupled, the first face and the second face being substantially mirror images; and, the plane of motion of coupling and decoupling of said male member and said female member being substantially parallel to the first face and the second face, the closure thereby being reversible.

4. The closure according to claim 1, further including:

said first channel being open to said top end and closed to said bottom end.

5. The closure according to claim 1, further including:

said second channel being open to both said top end and said bottom end.

6. The closure according to claim 1, further including:

said second channel being open along the entire length of said interior side of said female member.

7. The closure according to claim 1, further including:

said pin having a pin face adjacent to said web, said pin face being substantially flat to resist decoupling of said male and female members under tensile stress.

8. The closure according to claim 1, further including:

said male exterior side and said female exterior side each including a loop whereon one of said first and second ends is connected.

9. The closure according to claim 1, further including:

said acute angle of said pin and said male exterior side being between about three degrees and about fifteen degrees.

10. The closure according to claim 1, further including:

said pin having a pin bottom, said pin bottom being rounded to facilitate insertion into said first channel.

11. A reversible brassiere, comprising a garment having a first end and a second end and a closure detachably connecting said first end and said second end, said closure including:

a male member having a body, a male exterior side connected to said first end, a pin positioned at an acute angle to said male exterior side, and a web connecting said pin to said body;

a female member having a top end, a bottom end, an interior side, a female exterior side connected to said second end, a first channel for receiving said pin, a second channel for receiving said body, and a slit connecting said first channel and said second channel, said slit loosely receiving said web;

when said pin is inserted into said first channel, thereby coupling said male member and said female member and connecting said first and second ends, said male exterior side and said female exterior side being substantially parallel and said acute angle of said pin providing resistance to decoupling said male member from said female member;

a first face and a second face, said second face being substantially a mirror image of said first face when said male member and said female member are coupled; and, the plane of motion of coupling and decoupling said male member and said female member being substantially parallel to said first face and said second face, said closure thereby being reversible.

12. The brassiere according to claim 11, further including:

said first channel being open to said top end and closed to said bottom end.

13. The brassiere according to claim 11, further including:

a locking mechanism on at least one of said male and female members for resiliently resisting decoupling of said male and female members.

14. The brassiere according to claim 13, further including:

said second channel being open to said top end, said bottom end, and along the entire length of said interior side of said female member.

15. The brassiere according to claim 13, further including:

said pin having a pin face adjacent to said web, said pin face being substantially flat to resist decoupling of said male and female members under tensile stress.

16. The brassiere according to claim 13, further including:

said male exterior side and said female exterior side each including a loop whereon one of said first and second ends is connected.

17. The brassiere according to claim 13, further including:

said acute angle of said pin and said male exterior side being between about three degrees and about fifteen degrees.

18. The brassiere according to claim 13, further including:

said pin having a pin bottom, said pin bottom being rounded to facilitate insertion into said first channel.

* * * * *